United States Patent [19]

Laing et al.

[11] Patent Number: 4,772,184

[45] Date of Patent: Sep. 20, 1988

[54] PISTON PUMP FOR ABRASIVE CONVEYANCES

[76] Inventors: Karsten A. Laing, 1253 La Jolla Rancho Rd., La Jolla, Calif. 92037; Birger J. Laing, Reuterstrasse 5, D 78 Freiburg, Fed. Rep. of Germany, 7800; Doerte A. Laing, Hofenerweg 37, D 7148 Remseck-2, Fed. Rep. of Germany

[21] Appl. No.: 908,021

[22] Filed: Sep. 16, 1986

[51] Int. Cl.[4] ..... F04B 19/00; F04B 29/00

[52] U.S. Cl. ..... 417/461; 92/87; 417/568

[58] Field of Search ..... 92/87, 248; 417/568, 417/461, 457, 434, 454, 900

[56] References Cited

U.S. PATENT DOCUMENTS

| | | | |
|---|---|---|---|
| 415,497 | 11/1889 | Cavallaro | 92/162 |
| 1,527,948 | 2/1925 | Word | 417/461 |
| 1,831,411 | 11/1931 | Dietz | 417/551 |
| 2,220,822 | 11/1940 | Grad | 92/87 |
| 2,529,457 | 11/1950 | Nilsson | 417/900 |
| 2,776,626 | 1/1957 | Bowman | 417/461 |
| 3,093,087 | 6/1963 | Hansen | 92/248 |
| 3,142,257 | 7/1964 | Schodt | 417/461 |
| 3,495,544 | 2/1970 | Enssle | 417/568 |
| 3,507,584 | 4/1970 | Robbins, Jr. | 417/568 |
| 4,477,236 | 10/1984 | Elliott | 417/454 |

*Primary Examiner*—William L. Freeh

[57] ABSTRACT

The invention relates to reciprocating pumps for liquids and gases, especially fluid-solid dispersions containing abrasives. The cylinder is made from material which is harder than the abrasive particles of the fluid. This cylinder rotates around the piston, independent of the number of strokes per minute, so that a lubricating film is formed. This rotation prevents both contact between the piston and the cylinder and freezing of the piston within the cylinder.

2 Claims, 1 Drawing Sheet

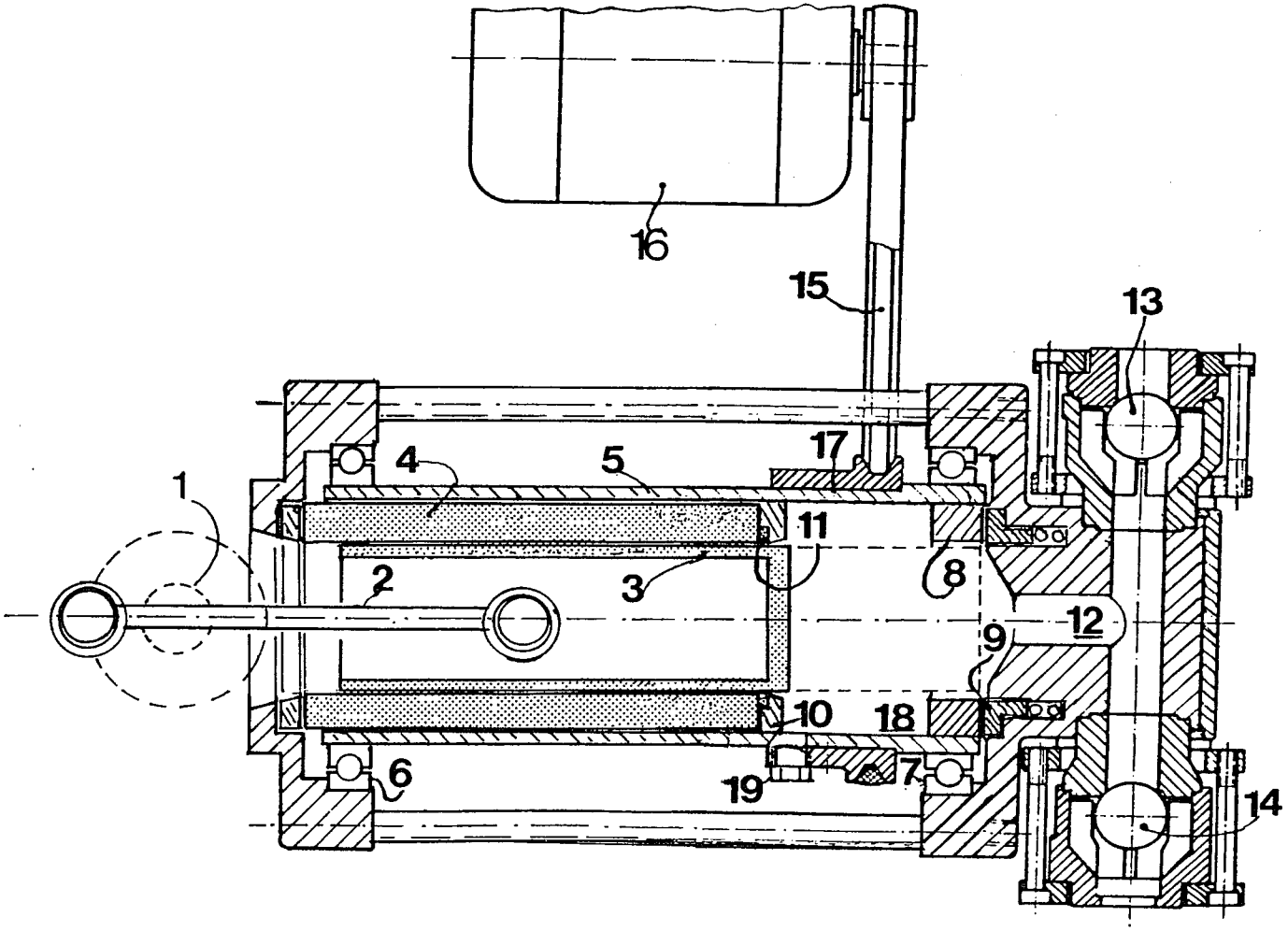
1
2
3
4
5
6
7
8
9
10
11
12
13
14
15
16
17
18
19

PISTON PUMP FOR ABRASIVE CONVEYANCES

BACKGROUND OF THE INVENTION

Rotary pumps for abrasive fluids, commonly used as chemical pumps, concrete pumps, or gravel pumps, have as a rule, cylinders made from a hard material in which a piston reciprocates. The bottom of these pistons consists of a rubber or rubber-like material. These pumps suffer extremely high wear and frequent freezing, by formation of a deposit between the piston and the cylinder.

The invention relates to reciprocating pumps, where pistons and cylinders, as well as the inlet and outlet valves, consist of a material with a hardness above the hardness of the abrasives to be conveyed. The invention reduces wear by providing relative rotational velocity between piston and cylinder. This rotation enables the piston to glide without making contact with the cylinder. Thus piston and cylinder execute a turning movement with a high enough speed so that a hydro-dynamic film develops in the working clearance. This movement around the axis of the piston is superposed on axial movement between piston and cylinder. According to the invention, the piston, as well as the cylinder, consist of materials with a hardness higher that that of the abrasive particles if it is intended to convey such liquids. To avoid dirt accumulation, the cylinder can be formed with one annular area where dirt particles can settle. As soon as the dirt particles build up on the surface of the piston, they are brought by the piston ring into said annular space being stripped away when the piston reverses. The principle of the invention is suitable for all liquids from low to high viscosity, but also for gases, so that the invention is also appropriate for conveyance of gas and also of gas loaded with abrasive powder.

DESCRIPTION OF THE DRAWING

A crankshaft 1 is connected to the piston 3 by the piston rod 2. The piston 3 is guided by the inner cylinder 4, both made from a hard compound. This cylinder 4 forms a unit with the tube 5 which is rotatably mounted by the ballbearings 6 and 7. The rotating ring 8, part of the tube 5, forms an axial seal with the stationary ring 9 being springloaded by a spring. A ring 10, mounted on the inner end of the cylinder 4, forms a slot with said cylinder 4. This slot surrounds a piston ring 11, made from flexible ceramic material such as zirconia. This ring 11 cleans the surface of the piston 3 during each stroke directed towards the crankshaft 1. The debris will be conveyed together with the fluid or will be collected within the annular space 18. The screw 19 permits access to said space 18 for cleaning. The channel 12 connects the cylinder 4 with the inlet valve 13 and the outlet valve 14. A V-belt 15 transmits the rotation of the motor 16 to the pulley 17 so that the cylinder 4, together with the tube 5 and the sealing ring 8, form a rotating unit that creates hydro-dynamic lubrication between piston 3 and cylinder.

We claim:

1. Piston pump for liquids having on its liquid end an inlet valve (13) and an outlet valve (14), a cylinder (4) rotably mounted in a frame and rotated by a motor (16) and a piston (3) which reciprocates and is driven by a crankshaft (1) which transmits the mechanical forces to the piston (3) which conveys the liquid from the inlet valve (13) to the outlet valve (14), the clearance between piston (3) and cylinder (4) being filled with liquid which builds up hydrodynamic forces due to the rotation which separte the outer cylindrical surface of the piston (3) from the inner surface of the cylinder (4), said piston being surrounded by a ceramic ring (11) situated on the wet end portion of said cylinder (4) which forms together with an annular ring (8) an annular space (18) and that there are means for providing access to said space (18) for removal of debris.

2. Piston pump according to claim 1, characterized in that the piston (3) and the cylinder (4) are made from ceramic material.

* * * * *